US008276304B2

(12) United States Patent
Samson et al.

(10) Patent No.: US 8,276,304 B2
(45) Date of Patent: Oct. 2, 2012

(54) MODULAR FORE-END RAIL ASSEMBLY FOR FIREARMS

(76) Inventors: Scott W. Samson, Spofford, NH (US); Kenneth Lankarge, West Hartford, CT (US)

( * ) Notice: Subject to any disclaimer, the term of this patent is extended or adjusted under 35 U.S.C. 154(b) by 943 days.

(21) Appl. No.: 11/326,665

(22) Filed: Jan. 6, 2006

(65) Prior Publication Data

US 2006/0260169 A1 Nov. 23, 2006

Related U.S. Application Data

(60) Provisional application No. 60/644,890, filed on Jan. 18, 2005.

(51) Int. Cl.
*F41A 21/48* (2006.01)
*F41A 11/02* (2006.01)
*F41G 1/38* (2006.01)

(52) U.S. Cl. ..... 42/75.02; 42/72; 42/112; 42/124; 42/85

(58) Field of Classification Search ..... 42/85, 75.01, 42/75.02, 71.01, 124, 72, 112
See application file for complete search history.

(56) References Cited

U.S. PATENT DOCUMENTS 3,075,314 A * 1/1963 Bakker ..... 42/71.01
4,536,982 A * 8/1985 Bredbury et al. ..... 42/71.01
4,663,875 A * 5/1987 Tatro ..... 42/71.01
5,142,806 A 9/1992 Swan
5,198,600 A 3/1993 E'Nama
5,343,650 A * 9/1994 Swan ..... 42/117
5,533,292 A 7/1996 Swan
5,590,484 A * 1/1997 Mooney et al. ..... 42/111
5,613,316 A * 3/1997 Hightower ..... 42/85
5,826,363 A * 10/1998 Olson ..... 42/75.01
6,453,594 B1 * 9/2002 Griffin ..... 42/105
6,490,822 B1 12/2002 Swan ..... 42/71.01
6,499,245 B1 12/2002 Swan ..... 42/71.01
6,508,027 B1 * 1/2003 Kim ..... 42/124
6,618,976 B1 9/2003 Swan
6,655,069 B2 12/2003 Kim
6,671,990 B1 * 1/2004 Booth ..... 42/75.01
6,694,660 B1 * 2/2004 Davies ..... 42/75.01
6,779,288 B1 * 8/2004 Kim ..... 42/72
6,792,711 B2 9/2004 Battaglia
6,839,998 B1 1/2005 Armstrong
6,895,708 B2 * 5/2005 Kim et al. ..... 42/72
7,059,076 B2 6/2006 Stoner et al.
2003/0230022 A1 12/2003 Battaglia
2004/0000083 A1 * 1/2004 Grant, Jr. ..... 42/112
2004/0049964 A1 * 3/2004 Vais ..... 42/75.02
2005/0000142 A1 * 1/2005 Kim et al. ..... 42/124

* cited by examiner

*Primary Examiner* — Bret Hayes

(57) ABSTRACT

A modular fore-end rail assembly for mounting onto a firearm includes an upper hand guard, a lower hand guard and a clamping member that combines with the rear portion of the upper hand guard to encircle and clamp onto the barrel nut thereby supporting the entire assembly from the front of the upper receiver and preventing any transfer of load into the barrel. The lower portion of the hand guard is slidably received into channels formed in the upper hand guard and is retained in its installed position by a spring biased detent located in the clamping member. The lower hand guard is removable by simply depressing the detent and sliding the lower hand guard forward. By providing for the easy removal of the lower hand guard, other auxiliary devices may be mounted to the upper hand guard.

13 Claims, 7 Drawing Sheets

MODULAR FORE-END RAIL ASSEMBLY FOR FIREARMS

CROSS-REFERENCE TO RELATED APPLICATIONS

This application is related to and claims priority from earlier filed U.S. Provisional Patent Application No. 60/644,890, filed Jan. 18, 2005, the contents of which are incorporated herein by reference.

BACKGROUND OF THE INVENTION

The present invention relates generally to a modular fore-end rail assembly for firearms. More specifically, the present invention relates to a modular fore-end rail assembly for retrofitting a firearm that includes an upper hand guard portion, which is clamped around and supported by the barrel nut and a removable lower hand guard portion that is mounted onto the upper hand guard portion to fully surround the firearm barrel.

In the general field of combat and commercial weaponry, there is a broad range of accessories available for mounting onto standard firearms in order to upgrade the capability of these weapons. Of particular interest in the context of upgrade accessories is the M16/M4 weapon system that is typically utilized in military or combat settings. Generally, the M16/M4 weapon includes a lower receiver, an upper receiver, a butt stock extending rearwardly from the upper and lower receivers and a barrel that is attached to the front of the upper receiver and extends in a forward direction. Referring to FIGS. 1 and 2, an M16 weapon system is shown and generally illustrated at 10. As can be seen, the barrel 18 is attached to the front of the upper receiver 14 by inserting the rear end of the barrel into a barrel-receiving receptacle 20 at the front end of the upper receiver 14. A pin 22 on the barrel 18 aligns with a notch 24 in the barrel-receiving receptacle 20 to insure that the barrel 18 is properly aligned with the upper receiver 14 when the barrel is installed into the barrel-receiving receptacle 20. The barrel 18 is held in assembled relation with the upper receiver 14 by a barrel nut 26 that is threaded onto the outside surface of the barrel-receiving receptacle 20. In this manner, the barrel nut 26 is rigidly engaged with the barrel receiving receptacle 20 and the upper receiver 14 of the weapon 10, while also serving to retain the barrel 18 in its installed position. A "delta ring" 28 (FIG. 1) encircles the barrel nut 26 and provides a spring loaded ring for attachment and support of the M16/M4 standard hand guards (not shown) between the delta ring 28 and a forward receptor cap 32 mounted at the front end of the barrel 18. A gas tube 29 extends from the upper receiver 14 to the receptor cap 32 at the front end of the barrel 18. The standard hand guards, when installed, encircle and protect both the barrel 18 and gas tube 29.

Most new models of the M16/M4 weapons also include a dovetail rail interface 30 integrally formed along the top of the upper receiver 14. This interface rail 30 provides a convenient mounting point for many of the available accessories for use with the M16/M4 firearm such as scopes, sighting devices, lasers and directed fire devices. However, since this rail interface 30 extends only along the upper receiver 14 it is limited in length to the length of the upper receiver 14. The difficulty is that many military personnel have multiple sighting devices in addition to a variety of lighting devices, accessory handgrips, etc. that could also be attached to the weapon for enhanced use of the weapon. In view of the broad range of add on accessories, there is not enough space on the rail interface 30 provided on the upper receiver 14 to accommodate all of the accessories that the user may desire to use. Accordingly, there is a clear need for integration systems that include additional dovetail rail interfaces in order to support the wide variety of auxiliary equipment that is needed while also being able to withstand rigors of combat use and abuse.

While there have been many attempts in the prior art to provide additional dovetail rail interfaces, the difficulty found in most of the prior art interface rails is that they require support both on the receiver end as well as at the end of the barrel. As can be appreciated, by supporting one end of the interface rail on the barrel in this manner, additional weight and/or shocks are transferred into the barrel and more critically to the point of attachment between the barrel and the upper receiver. Such load transfer can adversely affect the alignment of the barrel with the upper receiver, which in turn interferes with the reliable function of the weapon.

To avoid transferring additional loads into the barrel of the firearm and avoid bending and "droop" along the longitudinal axis of the barrel that may be caused by excess weight near the front end of the barrel, the barrel must be isolated from the fore-end attachment. The benefits of mounting the fore-end attachment in a manner that isolates the barrel include the ability to prevent heat transfer from the barrel to the accessory devices mounted on the fore-end attachment as well as to provide a structure that will bear the weight of the accessories without transferring additional loads into the barrel.

Recognizing these benefits, there are numerous interface rail attachments in the prior art that have attempted to minimize the amount of weight carried by the barrel by attaching to both the upper receiver and the barrel. However in such configurations, the weight of any accessories mounted on the interface rail system is still partially carried by the front end of the barrel. There are other rail interface systems in the prior art that are supported directly from the upper receiver of the weapon and do not require any support from the gun barrel. However, many of these devices require removal and replacement of the original barrel nut with a modified barrel nut that includes a means for interfacing and supporting the rail. Other disadvantages include the fact that frequently these devices are formed as a unitary tubular assembly thereby preventing access to the barrel once the tubular assembly is installed.

Accordingly, there is a need for a modular fore-end rail assembly for mounting accessories to a firearm that supports the accessories without introducing loads or additional stresses into the barrel of the firearm. There is a further need for a modular fore-end rail assembly that can be mounted to a firearm that derives its structural support entirely from the upper receiver of the firearm while not requiring the replacement of modification of the existing barrel nut. Finally, there is a need for a modular fore-end rail assembly that provides an easily removable portion that allows access to the barrel of the firearm without having to remove the entire assembly from the firearm.

BRIEF SUMMARY OF THE INVENTION

In this regard, the present invention provides for modular fore-end rail assembly that is mounted onto a firearm that serves both as a hand guard system and as an integrated interface system for mounting attachments thereto. In particular, the present invention is particularly directed to an improved mounting configuration for attaching the modular fore-end rail assembly onto the firearm without deriving support from the firearm barrel or requiring modification of the barrel nut.

The fore-end rail assembly includes an upper hand guard, a lower hand guard and a clamping member that combines with the rear portion of the upper hand guard to encircle and clamp onto the barrel nut thereby supporting the entire assembly from the front of the upper receiver and preventing any transfer of load into the barrel.

Additionally, the present invention includes a novel three-piece construction that facilitates removal of the lower portion of the hand guard for access to the barrel without requiring the removal of the entire fore-end rail assembly from the firearm. The lower portion of the hand guard is slidably received into channels formed in the upper hand guard and is retained in its installed position by a spring biased detent located in the clamping member. The lower hand guard is removable by simply depressing the detent and sliding the lower hand guard forward. It can be seen that by providing for the easy removal of the lower hand guard, other auxiliary devices may be mounted to the upper hand guard. For example, an M203 grenade launcher can be mounted to the upper hand guard in place of the lower hand guard portion.

Therefore, it is an object of the present invention to provide a modular fore-end rail assembly for mounting onto a firearm wherein the assembly is fully supported by the upper receiver of the firearm thereby preventing any transfer of load into the barrel itself. It is a further object of the present invention to provide a modular fore-end rail assembly that mounts onto and is supported by the standard barrel nut found on the M16/M4 weapons system thereby preventing any transfer of load into the barrel of the weapon. It is still a further object of the present invention to provide a modular fore-end rail assembly that includes a unique construction whereby the lower hand guard assembly is easily mounted onto and removed from the upper hand guard assembly thereby providing easy access to the barrel of the firearm while also facilitating the mounting of additional accessories.

These together with other objects of the invention, along with various features of novelty, which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
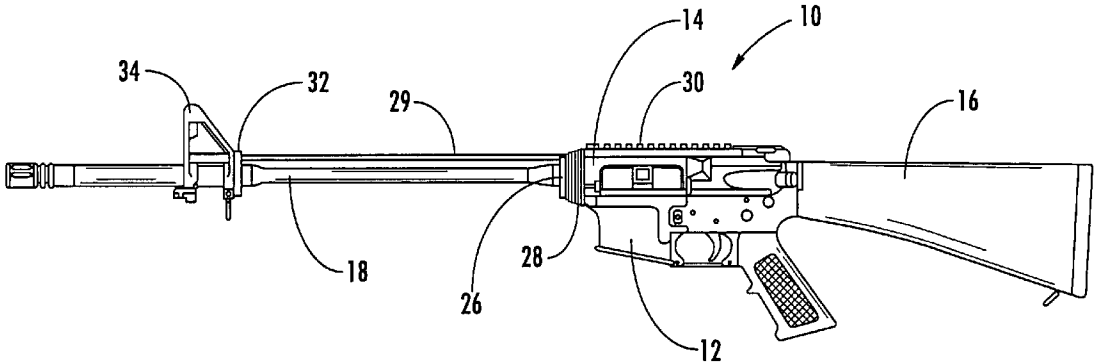
FIG. 1 is a side view of a conventional M16 firearm with the standard hand guards removed to show the barrel, barrel nut and delta ring.
Figure 2:
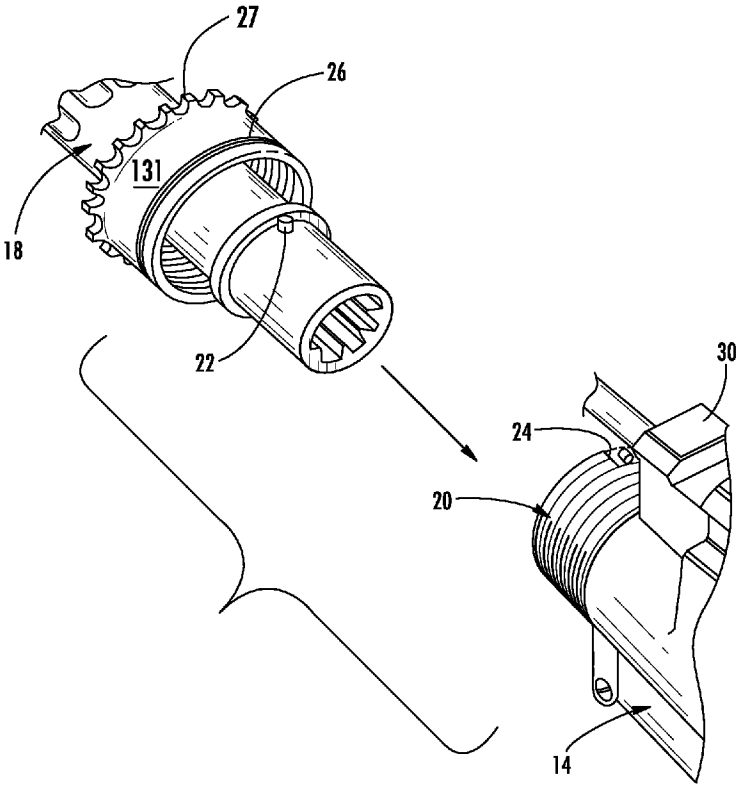
FIG. 2 is an exploded perspective view of the front end of the upper receiver, the rear end of the barrel and the barrel nut.
Figure 3:
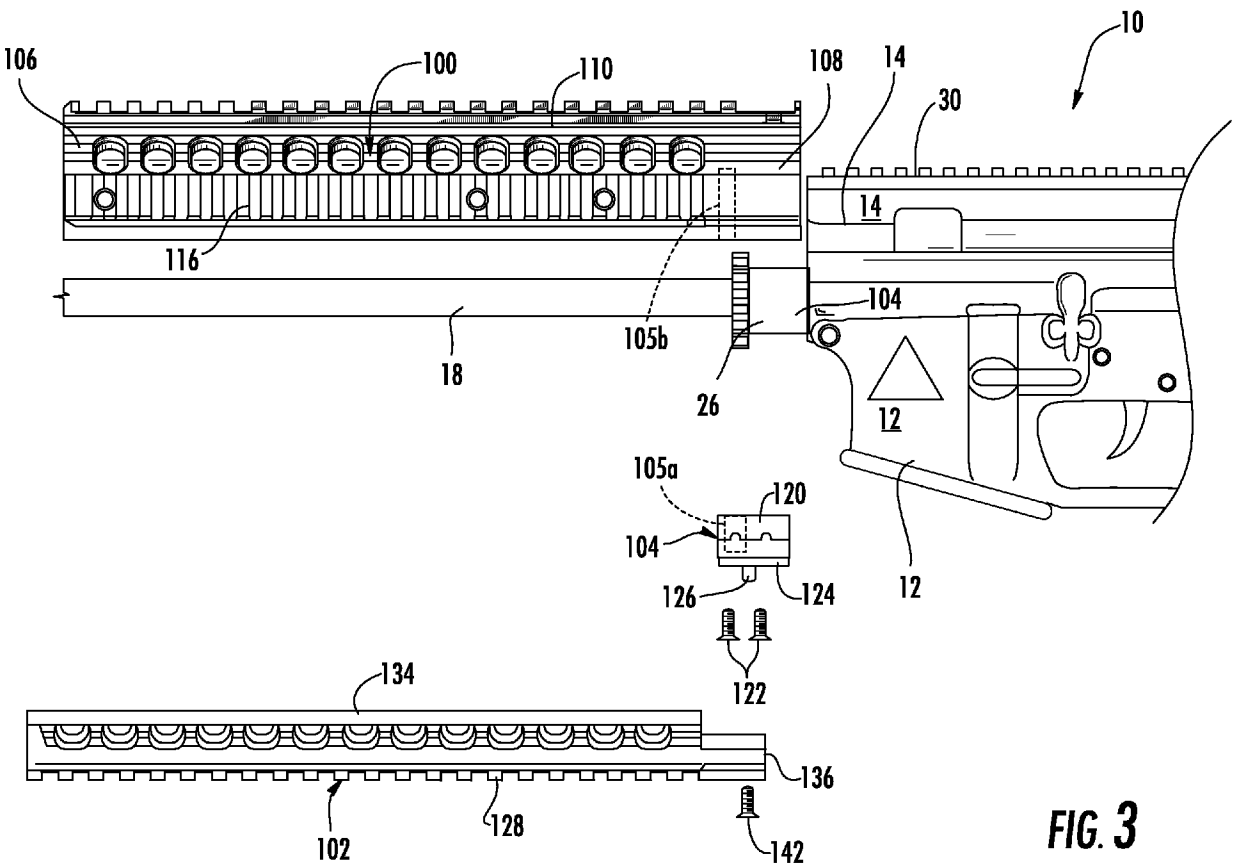
FIG. 3 is an exploded side view of the modular fore-end rail assembly of the present invention.
Figure 4:
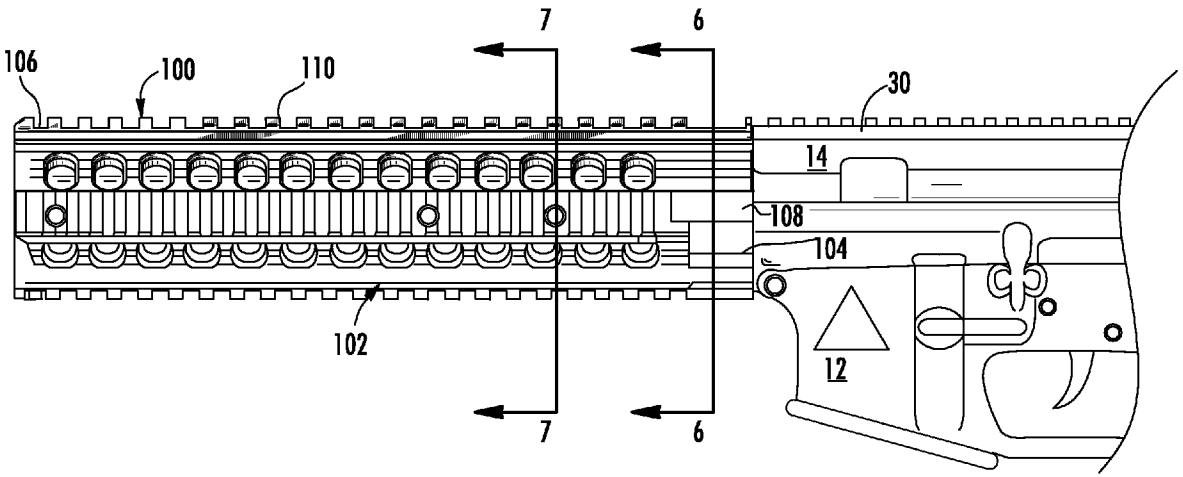
FIG. 4 an a side view of the modular fore-end rail assembly of the present invention shown installed onto a firearm with the lower hand guard in a fully engaged position.

Now referring to the drawings, the modular fore-end rail assembly of the present invention is shown and generally illustrated in FIGS. 3-8. As can be seen the modular fore-end rail assembly of the present invention generally includes an upper hand guard 100, a lower hand guard 102 and a clamping assembly 104.

The upper hand guard assembly 100 is the structural element that supports the entire fore-end rail assembly and serves to transfer the loads or additional weight induced by any attachments into the upper receiver 14 of the firearm 10. The upper hand guard 100 is formed generally as the upper half of a tubular enclosure that is configured to encircle the barrel 18 of the firearm 10 when the fore-end rail assembly is installed on the firearm 10 in a mounted position. The upper hand guard 100 has a forward end 106 and a rearward end 108 and a standard dovetail rail 110 extending longitudinally between the forward end 106 and the rearward end 108. The upper hand guard 100 has left and right side walls 112, 114 that extend generally outwardly and downwardly from the dovetail rail 110 forming the upper half of the tubular enclosure. The left and right side walls 112, 114 each have an interior and exterior surface and the walls each terminate at their lower ends with additional dovetail rail interfaces 116 extending along the exterior surface thereof and a channel formation 118 on the interior surface thereof. The channel formations 118 as will be described in more detail are provided to receive and retain the lower hand guard portion 102.

Figure 8:
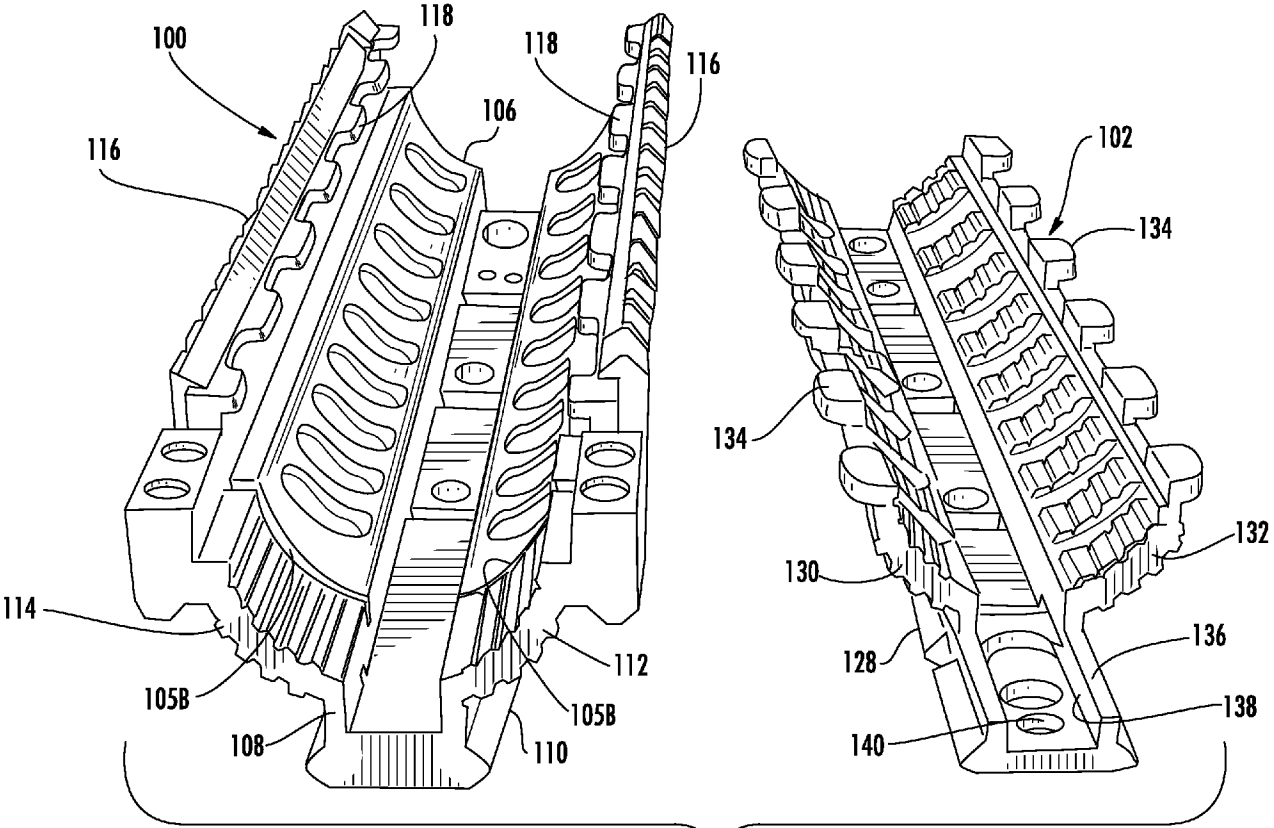
FIG. 8 is a perspective of the interior portion of the upper hand guard and the lower hand guard disassembled.

A clamping assembly 104 is provided at the rearward end 108 of the upper hand guard 100 in order secure the upper hand guard 100 to the firearm 10. Generally, the clamping assembly 104 is configured to cooperate with the rearward end 108 of the upper hand guard 100 to engage the existing barrel nut 26 on the fire arm 10 and thereby serves to support the entire assembly by clamping around the barrel nut 26. The clamping assembly 104 has a central semi-circular recess 105a therein and a flange 120 extending out to each side thereof. The rearward end 108 of the upper hand guard 100 includes a matching semi-circular recess 105*b* as well, which is best seen in FIG. 8. The clamping assembly 104 is attached to the rearward end 108 of the upper hand guard 100 with fasteners 122 that are inserted through openings in the flanges 120 on the clamp 104 and into threaded holes in the sidewalls 112, 114 of the upper hand guard 100. When the fasteners 122 are installed and tightened, the clamping assembly 104 is drawn to the upper hand guard 100 and the two components cooperate to engage the barrel nut 26 as well as the serrated flange 27 on the end of the barrel nut 26. In particular, the serrated flange 27 is captured in the semi-circular recesses 105*a*, 105*b* on the clamp 104 and the upper hand guard 100, respectively. This mounting configuration allows the clamp 104 and upper hand guard 100 to be mounted rigidly onto the firearm 10 while deriving all of the required structural support from the front of the upper receiver 14 and barrel nut 26 and eliminating any need to engage the barrel 18 of the firearm 10. All of the weight of the modular fore-end rail assembly and accessories that are mounted thereto is transferred effectively to the upper receiver upper 14 thereby protecting the barrel 18 from any additional transfer of load or shock. It should also be noted that when the upper hand guard 100 is assembled with the upper receiver 14, the dovetail rail 110 of the upper hand guard 100 is arranged so that it extends forwardly in substantially linear alignment with the dovetail rail 30 of the upper receiver 14 to form a continuous rail extending over the barrel 18.

Further, while fasteners 122 are shown extending through the clamping assembly 104 and into the upper hand guard 100, it should be appreciated that the fasteners 122 could also extend from the upper hand guard 100 and into the clamping assembly 104 and still fall within the disclosure of the present invention.

The clamping assembly 104 can be seen to include tabs 125 that extend rearwardly therefrom. The tabs 125 are rigid members that are spaced in a manner that allows the tabs 125 to engage the sides of the receiver 14 below the barrel receptor 20. The tabs 125 are provided to prevent rotation rail system 100 relative to the firearm 10 once the rail system 100 is installed. Another feature that is provided on the clamping assembly 104 is a ridge 124 that extends from the bottom thereof to engage and stabilize the lower hand guard 102 as will be described in detail below. Further, a protrusion is provided that extends from the ridge. This protrusion is a latching pin 126 that is spring biased in a manner that engages the lower hand guard 102 when it is in its fully installed position as will also be described in detail below.

Figure 5:
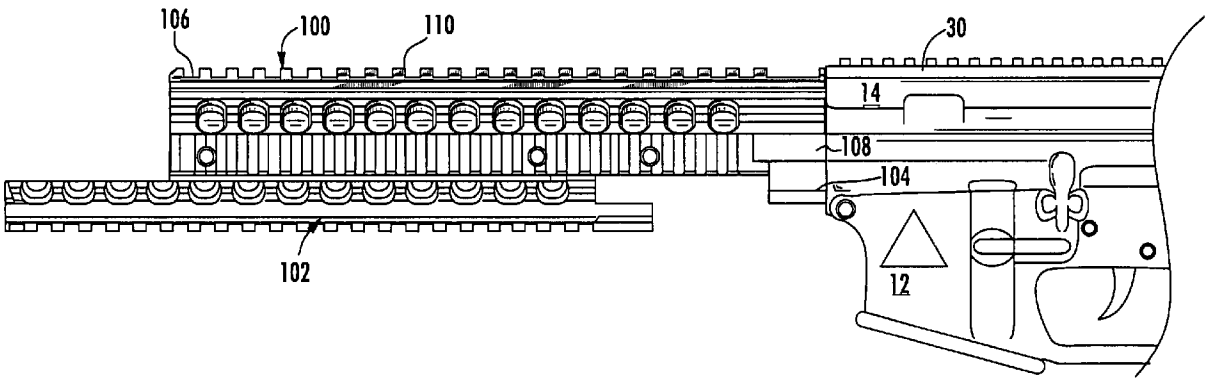
FIG. 5 is a side view of the modular fore-end rail assembly of the present invention with the lower hand guard partially disengaged.

The lower hand guard portion 102 is formed in a semi-circular shape that is complimentary to the upper hand guard portion 100 and completes a tubular enclosure around the barrel 18 of the firearm 10 when the lower hand guard 102 is mounted to the upper hand guard portion 100. The lower hand guard portion 102 generally includes a longitudinal rail interface 128 extending from the front end to the rear end. The lower hand guard portion 102 has sidewalls 130, 132 that generally extend upwardly and outwardly therefrom and terminate in mating formations 134 that are shaped and configured to engage the channels 118 along the bottom edges of the sidewalls 112, 114 of the upper hand guard portion 100. The lower hand guard 102 is therefore slidably engaged with the upper hand guard 100. Further, the interior surface of the rear end 136 of the lower hand guard portion 102 includes a key way 138 that is shaped to engage the ridge 124 on the bottom of the clamping assembly 104 to lend additional stability and structural integrity when the entire assembly is installed. A detent 140 is provided in this key way 138 to allow the latching pin 126 on the bottom of the clamping assembly 104 to engage the detent 140 and prevent the lower hand guard 102 from being accidentally dislodged from the upper hand guard 100. As can best be seen in FIG. 4 in conjunction with FIG. 6, when the lower hand guard 102 is in the fully installed position, the keyway 138 is received over the ridge portion 124 on the clamp 104 and the latching pin 126 is fully engaged with the detent 140 in the lower hand guard 102. Turning now to FIG. 5, it can be seen that when a user wishes to remove the lower hand guard 102, the latching pin 126 is depressed thereby allowing the latching pin 126 to clear the detent 140. In this manner, the lower hand guard 102 is allowed to slide forward to disengage it from the upper hand guard 100.

To provide additional support to the assembly when the lower hand guard 102 is in the installed position relative to the upper hand guard 100, a screw 142 may be installed through the rear end 136 of the lower hand guard 102 whereby the screw 142 serves to engage and further secure the lower hand guard 102 to the clamping assembly 104.

Figure 6:
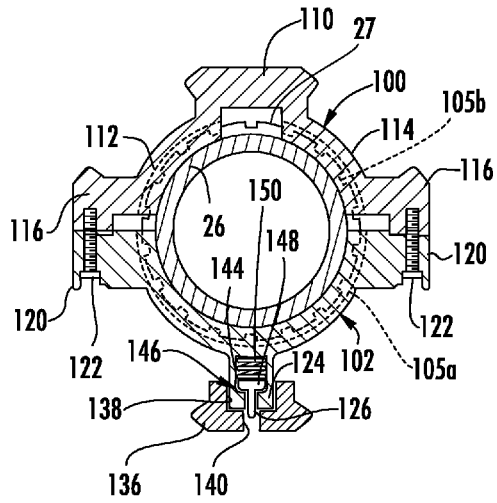
FIG. 6 is a cross sectional view taken along Line 6-6 shown in FIG. 4.
Figure 7:
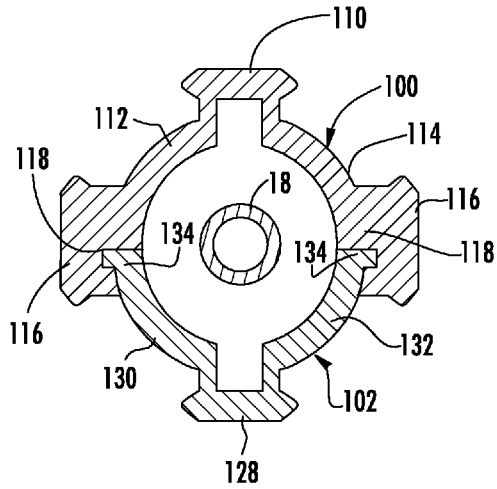
FIG. 7 is a cross sectional view taken along Line 7-7 shown in FIG. 4.

Turning to FIG. 6, it can be seen that the latching pin 126 is received in an aperture 144 that is formed in the clamping member 104. Preferably, the aperture 144 is formed in a fashion to include a shoulder region 146. This shoulder region 146 can be seen to cooperate with an enlarged head portion 148 of the latching pin 126 to prevent the latching pin 126 from dropping out of the aperture 144. A spring 150 can then be seen installed into the aperture 144 behind the latching pin 126 to exert a spring bias force against the head portion 148 of the latching pin 126, thereby urging it outwardly in a manner that engages the detent 140 in the lower hand guard 102. Further, it can be seen that the interior end of the spring 150 is captured between the clamping assembly 104 and the exterior surface of the barrel nut 26 thereby preventing it from falling out in that direction when the clamp 104 is in its installed position. To further assist in retaining the spring 150 and latching pin 126 in the clamp 104, a cap (not shown) may be pressed into the rear portion of the aperture 144 serving to capture the spring 150 and latching pin 126 in their installed positions.

While a specific configuration for the latching assembly of the present invention has been described by way of the preferred embodiment, a variety of other spring biased latching assemblies may be utilized that still fall within the scope and spirit of the present invention. For example, a spring-loaded clip or lever may be provided in the lower hand guard 102 that in turn engages a detent that is provided in the clamping assembly 104. Optionally a spring loaded pin may also be provided in the lower hand guard assembly 102 that engages a detent in the clamping assembly 104 wherein the user releases the lower hand guard 104 assembly by pulling on the pin and sliding the lower hand guard 104 assembly forward. It can be appreciated by one skilled in the art that the various retention means provided above are meant as illustrative only and that a broad range of other retention means may be utilized to achieve the same result. Ultimately, the present disclosure is not meant to be limited by the above descriptions but to encompass any of the various well-known retention means within the body of prior art.

It can be therefore seen that the present invention provides a new and improved modular fore-end rail assembly for mounting onto a firearm without requiring attachment to or support from the gun barrel. It can be further seen that the present invention provides a modular fore-end rail system that includes an easily removable lower hand guard portion that is positively retained in its assembled position thereby preventing it from being accidentally dislodged. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A modular fore-end rail assembly for a firearm, said firearm including at least an upper receiver having a forward end and a rearward end, said upper receiver having a barrel receiving receptacle at said forward end thereof, said firearm further including a barrel received in said barrel receiving receptacle and a barrel nut received around an outer surface of said barrel receiving receptacle to retain said barrel within said barrel receiving receptacle, said modular fore-end rail assembly comprising:

an upper hand guard having a forward end and a rearward end, a dovetail rail extending longitudinally between the forward end and the rearward end and opposing side walls that extend outwardly and downwardly from said dovetail rail, said opposing side walls terminating in mounting channels, said rearward end of said upper hand guard including a first clamping member;

a clamp removably secured to said rearward end of said upper hand guard wherein said clamp cooperates with said first clamping member to engage said barrel nut, said clamp having an exterior surface including a spring biased latch member; and a lower hand guard including side walls that extend outwardly and upwardly, said side walls terminating in mating formations that are configured to be slidably received in said mounting channels in said upper hand guard and a latch receiver at a rearward end thereof, wherein said latch member releasably engages said latch receiver when said lower hand guard is engaged with said upper hand guard.

2. The modular fore-end rail assembly of claim 1, wherein said latch member is spring biased to a first engaged position, said latch member being selectively depressible from said first position to a second disengaged position.

3. The modular fore-end rail assembly of claim 2, wherein depressing said latch member to said second disengaged position allows a user to slide said lower hand guard in a forward direction and remove said lower hand guard from said upper hand guard.

4. The modular fore-end rail assembly of claim 1, wherein said latch member further comprises:

an aperture extending thorough said exterior surface of said clamp member;

a latch pin having a first end and a second end, said latch pin slidably received within said aperture;

a spring disposed within said aperture adjacent said second end of said latch pin, wherein said spring exerts a spring force on said latch pin causing said first end of said latch pin to extend at least partially beyond said exterior surface into said engaged position.

5. The modular fore-end rail assembly of claim 1, wherein said clamp includes a ridge extending outwardly from said exterior surface and said lower hand guard includes a keyway on an interior surface of said rearward end, wherein said keway engages said ridge when said lower hand guard is received in assembled relation with said upper hand guard.

6. A modular hand grip for use on a firearm, the modular hand grip comprising:

an upper portion having a forward end, a rearward end, an inner surface and an outer surface, the rearward end is configured to engage a top portion of a barrel nut;

lug rails project from the inner surface of upper portion at opposing sides and proximate edges thereof, the lug rails extend longitudinally from proximate the forward end to a position proximate the rearward end and include a plurality of gaps formed therein;

a clamp assembly for engaging a bottom portion of the barrel nut is attached to the rearward end of the upper portion;

a lower portion having a top section and opposing side sections extending therefrom and each terminating at an edge, a plurality of spaced apart lugs extending from each edge and receivable in the gaps in the lug rails of the upper portion and translatable in one of a forward direction and a rearward direction positioning the lugs under the lug rails; and a detent assembly carried by the clamp assembly for engaging the lower portion.

7. A modular hand grip as claimed in claim 6 wherein the detent assembly includes a plunger detent biased outwardly from a central portion of the clamping assembly and received in an aperture formed through a rearward end of the top section when the lugs are positioned under the lug rails.

8. A modular hand grip as claimed in claim 7 wherein the plunger detent is biased outwardly by a compression spring.

9. A modular hand grip for use on a firearm, the modular hand grip comprising:

a barrel nut including a cylindrical portion terminating at a forwardly directed end with a radially outwardly directed flange;

an upper portion having a forward end, a rearward end, an inner surface and an outer surface;

a groove formed in the inner surface of the upper portion, perpendicular to a longitudinal axis thereof, and spaced from the rearward end, the groove receiving the flange of the barrel nut to align the upper portion and to prevent longitudinal movement thereof;

a clamp assembly engaging a bottom portion of the barrel nut and attached to the rearward end of the upper portion;

a lower portion having a top section and opposing side sections extending therefrom and each terminating at an edge coupled to the upper portion;

a detent assembly carried by the clamp assembly for engaging the lower portion; and wherein the upper portion further includes lug rails projecting from the inner surface at opposing sides and proximate edges thereof, the lug rails extending longitudinally from proximate the forward end to a position proximate the rearward end and including a plurality of gaps formed therein, and the lower portion further includes a plurality of spaced apart lugs extending from each edge thereof and receivable in the gaps in the lug rails of the upper portion and translatable in one of a forward direction and a rearward direction positioning the lugs under the lug rails.

10. A modular hand grip as claimed in claim 9 wherein the detent assembly includes a plunger detent biased outwardly from a central portion of the clamping assembly and received in an aperture formed through a rearward end of the top section when the lugs are positioned under the lug rails.

11. A modular hand grip as claimed in claim 10 wherein the plunger detent is biased outwardly by a compression spring.

12. A modular hand grip on a firearm comprising:

a firearm having a receiver, a barrel, and a barrel nut including a cylindrical portion terminating at a forwardly directed end with a radially outwardly directed flange, the barrel nut coupling the barrel to the receiver;

an upper portion having a forward end, a rearward end, an inner surface and an outer surface;

a groove formed in the inner surface of the upper portion, perpendicular to a longitudinal axis thereof, and spaced from the rearward end, the groove receiving the flange of the barrel nut to align the upper portion with the receiver and to prevent longitudinal movement thereof;

a clamp assembly engaging a bottom portion of the barrel nut and attached to the rearward end of the upper portion; and a lower portion having a top section and opposing side sections extending therefrom and each terminating at an edge coupled to the upper portion, the upper portion and the lower portion encircling the barrel;

the upper portion further includes lug rails projecting from the inner surface at opposing sides and proximate edges thereof, the lug rails extending longitudinally from proximate the forward end to a position proximate the rearward end and including a plurality of gaps formed therein, and the lower portion further includes a plurality of spaced apart lugs extending from each edge thereof and receivable in the gaps in the lug rails of the upper portion and translatable in one of a forward direction and a rearward direction positioning the lugs under the lug rails; and a detent assembly carried by the clamp assembly for engaging the lower portion.

13. A modular hand grip as claimed in claim 12 wherein the detent assembly includes a plunger detent biased outwardly from a central portion of the clamping assembly and received in an aperture formed through a rearward end of the top section when the lugs are positioned under the lug rails.

* * * * *